US005338275A

United States Patent [19]

Chek

[11] Patent Number: 5,338,275

[45] Date of Patent: Aug. 16, 1994

[54] HYDRO-THERAPEUTIC REHAB-FOOTGEAR

[76] Inventor: Paul W. Chek, 8308 (#1-E) Regency Rd., San Diego, Calif. 92122

[21] Appl. No.: 3,442

[22] Filed: Jan. 12, 1993

[51] Int. Cl.[5] ..... A63B 21/008

[52] U.S. Cl. ..... 482/111; 482/55; 441/61; 441/64

[58] Field of Search ..... 482/55, 111; 441/61, 441/62, 63, 64

[56] References Cited

U.S. PATENT DOCUMENTS

| | | | |
|---|---|---|---|
| 335,015 | 1/1886 | Corbett | 441/61 |
| 1,524,304 | 1/1925 | Parks | 441/61 |
| 1,607,857 | 11/1926 | Zukal | 441/61 |
| 1,745,280 | 1/1930 | Snapp | 441/61 |
| 1,868,270 | 7/1932 | Bellman | 441/61 |
| 2,094,532 | 9/1937 | Glad | 441/62 |
| 2,395,044 | 3/1946 | Bufkin | 441/61 |
| 3,031,696 | 5/1962 | Brabb . | |
| 3,084,355 | 4/1963 | Ciccotelli | 441/61 |
| 4,411,422 | 10/1983 | Solloway . | |
| 4,521,011 | 6/1985 | Solloway . | |
| 4,731,039 | 3/1988 | Zeiss . | |
| 4,813,668 | 3/1989 | Solloway . | |
| 4,973,049 | 11/1990 | Clolino . | |
| 4,988,094 | 1/1991 | Beasley . | |
| 5,031,904 | 7/1991 | Solloway . | |

FOREIGN PATENT DOCUMENTS

| | | | |
|---|---|---|---|
| 0032850 | 5/1908 | Austria | 441/62 |
| 0180524 | 12/1954 | Austria | 441/61 |

*Primary Examiner*—Richard J. Apley
*Assistant Examiner*—Lynne A. Reichard
*Attorney, Agent, or Firm*—Inventech

[57] ABSTRACT

This invention is both preventive and corrective of a running athlete's muscle strength imbalances of the leg, hip, and back; facilitating specific rehabilitation of associated muscle injury. The sandal-like upper construction employs a special underside structure supportive of a flapper type hydro-resistance device having a special one-way drag-action. Since temperate water presents a constant given drag-factor, the user or therapist may readily readjust the extendable sole-flapper's induced hydro-drag length to suit particular therapy needs, and the capability of a given user. Additionally, the invention is constructed with special longitudinal-fin like risers, enabling user to walk upon a pool bottom without imposing scuffing damage to scuff-prone pool surfaces.

9 Claims, 1 Drawing Sheet

A.
B.

HYDRO-THERAPEUTIC REHAB-FOOTGEAR

BACKGROUND OF THE INVENTION

This invention relates to hydro-therapeutic foot-borne devices to be worn and utilized beneath the water; -and more specifically, it relates to such inventions intended to physiologically precondition an athlete's lower-extremities, or recondition distressed extremity conditions.

As a Neuromuscular-therapist treating a large number of running athletes, as well as being a runner/tri-athlete myself, it became evident to this inventor that distance running for extended time periods (over 5-years) commonly leads to sport specific imbalances; which brought me to develope an inexpensive corrective device.

Because the prime-movers in distance running (over 800 m) are the gastorc/soleus (calf-muscles), quadriceps (thigh muscles which straighten the knee), and iliopsoas (the primary flexors of the hip), their continued use encourages imbalances in strength and length with their antagonists (opposing muscles).

The quadriceps and the iliopsoas both alter the position of the pelvis as their normal relationship with their antagonist muscles becomes altered. As the quads and iliopsoas tend to shorten, the pelvis tends to tilt forward (anteriorly). This condition puts the hanstrings, which act as antagonists to the iliopsoas and quads, into a stretch. As the pelvis migrates further into anterior-tilt, the hamstrings are progressively strung taught. This is a prelude to hamstring-injury, because as the runner's stride-length opens (becomes longer), the hamstrings must be able to operate within a physiological, or normal range of motion-length. Because the hamstrings originate from the ischial-turberosity (sits bones), and insert at the tibia and fibula (bones of the lower-leg), this altered position of the pellvis will cause extensive microtrauma to the muscles. There are also both neurological and length/tension reasons why this postural change causes injury.

Because any muscle used in any sport is trained in a sport-specific manner, the hamstrings are very hard to adequately strengthen for running. This is because the hamstrings are two joint muscles, which function as both extensors of the hip (pulling the leg aftward) and flexors (benders) of the knee. Another important aspect making complete rehabilitation and prophylactic conditioning of the hamstrings hard to achieve in runners, is the rate of speed at which these muscles must operate during the running gait. The sprinter may induce joint rates of 1000-degrees/per-second at the knee, while a 5–10K runner may operate at half that speed, over extended periods of time.

The isokinetic machinery employed in physical-threapy today seldom operates at speeds over 400-degrees/per-second, resulting in relatively poor applicability to the running athlete. This lead me to develop a device which would facilitate strengthening of the hamstrings and gluteus maximus in the same neuromuscular gait-rate/ cycle-pattern experienced during actual running. This meant the device would have to strengthen (stress) the opposite (antagonist) muscles that normal running does; actually stressing the muscles much in the manner which tedious backward-running would.

It therefore became obvious to me that the only place I could adaquately meet the requirements of appropriate joint-speed, and induce variable-resistance in the same neuromuscular-pattern as an actual running-gait, was in the water; which unlike a cumbersome weighted-pully arrangement, that imposes a desirable isotonic resistance-factor only in select regions of the gait-cycle at any given time. Extensive trails employing different materials, drag-shapes, anchoring-strap systems, and alternate forms of gaiting-mechanisms, have brought me to conclude my present invention disclosure.

PROBLEMATICAL RELEVANT PRECEDING INVENTIONS

There are numerous devices having been invented for the purpose of walking upon the surface of a body of water, but which are not deemed suitable for the criteria established for hydro-therapeutic treatment of certain running disorder imbalances already discussed. For example, U.S. Pat. No. 3,031,696 (filed- 12/1958) sets forth a pair of non-submersible ski-like structures, made sufficiently thick with integral floatation-chamber as to induce buoyancy to the user above. Included thereunder, is a simple flapper-valve like hinged-paddle which resultantly retracts as the floatation-ski be walked forward, while pivoting down to a thin vertical stop-fin arranged just forward of the paddle member; thereby providing an alternating right, left, right -etc. drag-resistance, deemed to propel the user forward over the water. More recently U.S. Pat. No. 4,731,039 (filed-5/1984) shows a similar, albeit functionally improved pair of ski-like water-walking implements, likewise employing a singular self-retracting water-paddle for alternate propulsion. Accordingly, while there have been at least a dozen subsequent such water-walker devices patented since, each of which employing articulated one-way/resistance imposing provision, the two above patents appear most notably relevant to this disclosure.

Various sorts of underwater drag-inducing devices applicable for leg usage have also been patented, but none known to incorporate flaper-paddle type one-way resistance means. For example, U.S. Pat. Nos. 4,411,422, 4,521,011, 4,813,668, 5,031,904 by the same inventor, all feature an aquatic bootie-like apparatus cluttered with a series of laterally extending toe, foot, ankle, and lower-leg non-articulated V-cupped members serving to induce fluid-drag particularly in the aftward movement direction. However, because of the general drag imposed in both forward and aftward leg movement, the efficiency of this configuration for correcting flexor/extensor muscle imbalance of the hip for runners, is of no real benefit.

Still another foot-adapted embodiment is found in U.S. Pat. No. 4,988,094 (filed- 9/1988) wherein is provided an planar-disk like sandal having a transverse-strap into which the foot is inserted, the lower side of the sandal-disk having transversely opposed bell-shaped elements which are designed to induce bi-lateral fluid-resistance of leg-movement, while the disk portion provides bi-longitudinal fluid-resistance. Thus again, not offering the desired one-way mode of hydro-resistance required to target specific leg-muscle imbalance; nor the hydro-dynamics needed to assure the linear passage of an athletes legs passing through the water. Lastly, U.S. Pat. No. 4,973,049 (filed- 4/1989) is an aquadic-exerciser device of flexible construction, which may be strapped to one's hand or foot, however the inventor states that the difference between forward and aftward leg-movement fluid-resistance is not substantial; therefore again, the therapy provided would not be truly muscle-specific according to the object of my instant invention.

Accordingly, this inventor is preparing to produce the invention as the "A-rest" ® (convenient acronym for: "Active Resisted Extensor Strength Trainer") device, presently to be produced under the auspices of P.W. Chek Mfg./Mkt. Co., San Diego, Calif.

SUMMARY OF THE INVENTION

A.) In view of the foregoing discussion about the earlier invention art, it is therefore important to make it clear to others interested in the art, that the object of this invention is to provide a leg-muscle hydrotherapeutic device which contemplates greatly increased fluidic-resistance during aftward leg-movement, while contemplating minimal fluidic-resistance during forward leg-movement. Thus, in an abstract sense, -the notion of a foot suported structure serving to unite the foot with the operative components, further distinguished as having manually releasable universally-adjustable retentive means, including a hydro-resistance device thereto specially characterized as capable of exerting a distinctively hi-drag characteristic during aftward leg movement (requiring high muscle effort); yet alternatively, exerting a distinctively low-drag characteristic during forward limb movement, thereby requiring relatively low muscle effort; thereby after extended utilization, uniquely serving to restore fore/aft strength-balance to a formally imbalanced leg-muscle group.

Hence, the A-rest invention is a foot-mounted (supported), unidirectional, variable-resistance hydrotherapy device. A flexile, or more preferably freely-hinged hydro-paddle is positioned at the underside of the hi-impact plastic sole-plate member. The paddle is automatically drawn into a retractably-closed modality as the user's leg is moved through concerted hip-flexion and knee-extension, -realizing minimal hydro-resistance. However, as the leg is brought back through the water, in what would be the stance phase of a running-gait on land, -the water instantly catches the light-weight paddle, automatically draging it open preferably perpendicular to the sole-plate.

B.) The hydro-paddle is preferably made adjustably variable in hydro-resistance via three different extension settings, the hydro-paddle growing desirably longer as one therapeutically progresses through the selective muscle-resistive load-settings. It can be understood then, that as the wearer goes about running in a conventional swimming-pool, (ideally while being supported by a suitable floatation-belt) there is substantially added work-effort being imposed upon the hip-extensor and knee-flexor muscles. This differential resistance action is discovered to be vital, because these are the particular opposite muscles to those that normally generate one's movement in a running-gait. Hence, the novelty of this hydrotherapy device resides in it's direct corrective rehabilitation of the most commonly encountered imbalance known to the running athlete; -by unidirectionally focusing intense work-load on the knee-flexor and hip-extensor leg-musclature group, unknown to other types of underwater therapy device.

C.) A very important provision of this device, resides in the fact that it is used fully submersed within the water, so that there is virtually no axial-loading upon the user's skeleton; thereby enabling several important things to occur; for example:

a.) the body is floating in water, with the aid of a flotation device mounted either to one's wrist or the upper-body. This is significant, because as the user is running in the water, their joints are being decompressed; enhancing the body's natural joint-lubrication process, producing a positive neurological effect via mechano-receptor stimulation.

b.) the body does not have to fight the force of gravity in the water, meaning that the muscles, tendons, and joints can be exercised with minimal micro-trauma. This advantage also enables the hi-mileage runner to beneficially train additional miles in the pool without damage to the contractile tissues.

c.) the surface stimulation of the skin by the water during such water running, is believed to have a reflex effect upon the muscles, encouraging post-exercise relaxation.

d.) because the injured athlete that might otherwise be unable to run, can now run suspended in this rather "anti-gravity"-like aquadic-environment, there will not only be increased circulation to the damaged leg muscle-tissues, but the fibroblasts producing scar-tissue will be encouraged to lay down, along the lines of stress created in the injured tendons and muscles by such running activity. This is an extremely important point, because ideal alignment of the scar-tissue means that the natural repair will be stronger, aiding in the prevention of so called reoccurring injury of running.

e.) the running athlete that previously had an altered gait-pattern secondary to compensation for pain, may now run with a normal gait due to minimal or no proprioceptive (sensory) and or nociceptive (messages carrying pain) feed-back from injured joints or tissues. This important feature, allows the athlete to maintain their level of conditioning, the integrity of their gait, and their rationality, while recovering from a debilitating injury.

D.) Other advantages of this invention reside in the benefits derived from the A-rest invention, as compared to other aquadic-therapy devices. Heretofore for example, many running-athletes complain of having to enter a water-run routine, because they feel they can't get a good enough work-out. Another common complaint has been that runners feel they can't get their heart-rate built-up high enough. There are actually several benefits of using the A-rest device, which address the running-athlete's standard complaints about water-running; we will now look at them:

a.) because the A-rest device provides variable-resistance, it can be employed to improve both the strength and endurance of the hip-extensors and knee-flexors.

b.) the increased resistance to hip-extension and knee-flexion created by the A-rest, increases the metabolic demand of the working muscles above that of conventional water-running. This encourages the maintance of a runner's $VO^2$-max. in the working muscles; as well as maintaining their basal metabolic-rate, discouraging weight gain while being under the constraints of reduced activity secondary to injury.

c.) the increased resistance, creates increased oxygen uptake, which requires an increased heart-rate to meet the metabolic demands of the working musculature; thus, a remedy has now been created for the two most common complaints about water-running.

d.) because of the unidirectional hydro-paddle device on the A-rest footgear, it can be used as a means of propulsion, actually enabling the water-runner to travel forward at a pace faster than the standard water-runner would. Because a water-runner is preferably submerged to the neck-level region, there is substantial counter-rotational force required by the user to stabilize their body toward maintaining a straight-line path. This effort in of itself increases the demand of the workout, contributing to raising the heart-rate, leaving the runner with a feeling of satisfaction, as though they've really gotten a workout! The fact that there is increased forward propulsion when using the A-rest footgear, makes it an ideal implement to use for actually performing a distance-run in the water, be it the ocean, lake, or a 50-meter pool.

e.) on the third (most extended) level of the A-rest hydro-paddle setting, there is sufficient resistance that one A-rest may be worn at a time and used as a strength training device. The inventor has developed a protocol of hydro-exercises, designed to strengthen the upper and lower hamstrings, as well as the gluteus-maximus. After using the A-rest for this purpose, there is a noticeable sense of fatigue in the muscles having been so worked. This effect is seldom experienced with conventional water-running.

E.) While a primary object of this invention is to provide a biomechanical form of footgear which is non-corrosive, light-weight, easy to apply, and relatively inexpensive for the serious runner-athlete; still other applications are:

a.) injured athletes of any sport who are not able to workout effectively, due to inability to protect their injury from the force of gravity, and or the kenetic-energy that travels through the body when running, benefit tremendously from this invention.

b.) any running athlete looking for quality prophylactic-training, for prevention of muscle-imbalance injury and or cumulative-trauma injury.

c.) there are multiple applications to physical-therapy, -for ankle, knee, and hip injuries; to include the related musculatures.

d.) those with back-injuries of the extension or sway-back classification, can benefit from the added strength-training to the hip-extensors provided by the A-rest invention.

e.) the A-rest is an ideal training-aid for overweight individuals looking for a safe effective form of resistance-training; as well as a means of raising metabolic-rate.

f.) the A-rest is truly a variable-resistance device; and because water is an ideal constant-resistance medium, the load is imposed directly proportional to the effort exerted; giving the user virtually complete control over their own stress-level situation.

DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related points given in the text, as well as the Claims section annexed hereto; and accordingly, a better understanding of the invention and the variant uses is intended, by reference to the drawings, which are considered as primarily exemplary and not to be therefore construed as restrictive in nature.

ITEMIZED NOMENCLATURE REFERENCES

Figures 1, 2, 3, 4, 5, 6:
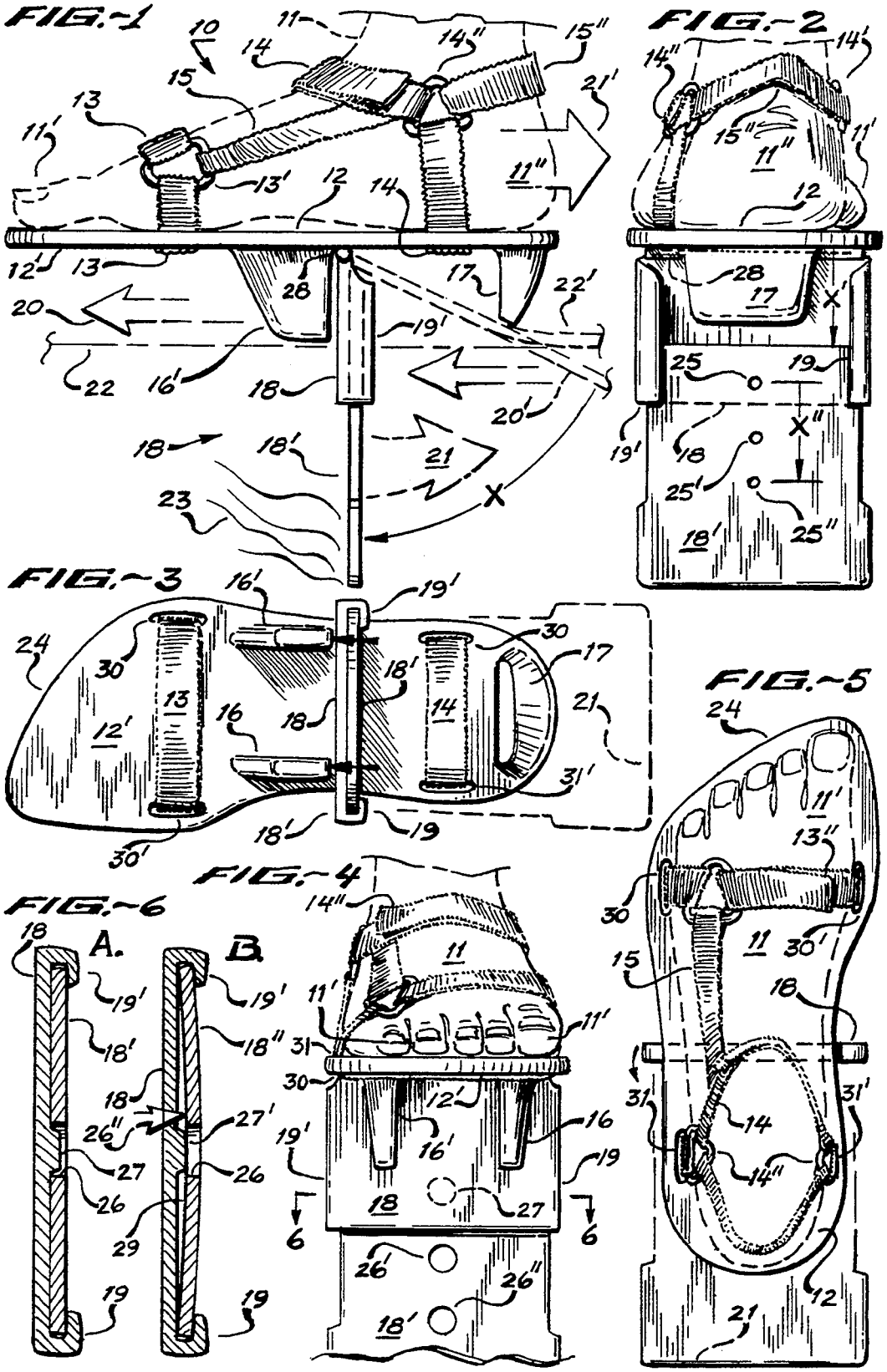
FIG. 1, is a side/elevation-view of an exemplified embodiment of the invention footgear, including a phantom-outline of a human's left-foot.
FIG. 2, is a rear/elevation-view thereof.
FIG. 3, is a bottom/plan-view thereof.
FIG. 4, is a frontal/elevation-view of the alternate right-foot embodiment thereof.
FIG. 5, is an upper/plan-view thereof.
FIG. 6, is an enlarged detail cross-section view as referenced 6:6 in FIG. 4, including sequential sections A & B, which have been rotated 90-degrees upon their side.

10—the overall invention
11, 11', 11''—human foot, toes, heel regions
12/12'—platform-sole, top/bottom
13, 13', 13''—front foot-retention strap, 3-way buckle, hook/loop-fastener
14, 14', 14''—aft foot-retention strap, 3-way buckle, hook/loop-fastener
15, 15', 15''—heel-strap, rear-strap, joiner-strap
16/16'—forward stops, inner/outer
17—aftward stop (heel pad)
18, 18', 18''—hydro-paddle assy., upper/lower-portions, lower-portion deflected
19, 19'—hydro-paddle slide-guides, inner/outer
20, 20'—forward action condition, ref.arrow
21, 21'—aftward action condition, ref.arrows
22, 22'—walking surface, paddle flex under-heel
23—water turbulence
24—leading-edge, platform-sole
25, 25', 25''—slide-adjustment indexing stations
26, 26', 26''—detent-holes, in lower-paddle
27, 27'—teat indexed, teat retracted
28—pivot/flex-point axis
29—front-side, lower hydro-paddle portion
30/30'—front strap locating-slots, inner/outer
31/31'—rear strap locating-slots, inner/outer

DETAILED DESCRIPTION OF THE PREFERRED EMBODIMENTS

Initial reference is given by way of FIG. 1, wherein is exhibited the overall aquadic hydro-therapy footgear invention 10, including a provisional human foot 11 resting upon the primary platform-sole top-surface 12. Here, it can be clearly seen how the footgear 10 is held securely to the foot 11 preferably by means of woven-nylon retention-straps front 13 and aft 14, plus heel-strap 15 and rear-strap 15', all of which are structurally united by joiner-strap 15''. The straps 13 and 14 actually encircle the aggregate foot 11 and platform-sole 12, and are held fast via well known VELCRO® (hook & loop)-fastener means; while the triad of merging straps are joined via triangular-buckles 13' and 14'.

Once thus mounted upon the foot, or the pair upon both feet, the wearer proceeds into the pool, it being noted here how walking-surface 22 in conjunction with the footgear heel 17 causes the hydro-pedal assembly 18 to become pronouncedly deflected 22' at it's lower region 18''. Because the hydro-padal assembly 18 is preferably injection-molded of rugged polycarbonate-plastic, it can endure repeated walking loads, even such as will be imposed while traversing a pool bottom. Additionally, the invention is constructed with special longitudinal fin like risers, enabling a user to walk upon a pool bottom without imposing scuffing damage to scuff-prone surfaces. Notice also, how the forward-stops 16 and 16' act as risers when one is in the walking mode; while the heel-stop also acts as a riser, it is slightly abbreviated in height so as to keep the sole-platform 12 at a substantially horizontal attitude above the trailing floppy hydro-paddle member 18. Although not shown, an essentially conventional stainless-steel axial-wound tension-spring may be included at swing-axis 28, so as to tendentiousnessly bias the hydro-paddle 18 aftward in retracted position under normal conditions; -thereby improving use of the footgear when walking out of water, while not adversely effecting water-borne operation.

Once the user is floating immersed in water, preferably up to their neck level, the illustration of FIG. 1 clearly demonstrates how forward action 20 (ref.arrow) of the foot, sends the hydro-paddle aftward 20' (ref.arrow). Retro-action of the leg thrusting the foot energetically to the rear 21', forces water against the backside of the hydro-paddle 18, whereby the retracted hydro-paddle 20' instantly extends (arrow-X) until it abuts against the backside of the preferably fin-like (for enhanced directional control) riser's forward-stops 16/16', whereupon a considerably resistive condition 21 (direction of leg-movement arrow) is felt, as suggested by turbulent-water area 23, until aftward thrusting effort is ceased and the on-going cycle repeated at the opposite foot.

As the both user's hip and knee-flexor muscles become reconditioned toward a balanced strength state, as explained earlier in the Invention-summary, the user may wish to extend the lower/hydro-paddle portion 18' from the fully-contracted index-position 25'' through positions 25' and 25 as suggested by ref.arrows X' and X'' in FIG. 2. This adjustment provision has been found to more appropriately stress the addressed muscle group, rather than impose perhaps excessive hydro-resistance upon often painful leg injury. However, for the purpose of increasing muscle strength specifically, the therapist may choose to develop a "high-resistance"-program requiring the paddle be employed in the extended position (as shown at paddle position 25. Prophylacticly, the more retracted settings (low and moderate resistance) may be used as a means of maintaining adequate conditioning (balance) for the prevention of aberrant flexor/extensor ratios; the fully retracted setting 25'' also being ideally useful in "maintaining" perfect conditioning, via a relatively rapid turnover rate (repetitions) if desired. The case of FIG. 2 indicates index-station 25 as an exemplified substantially conventional screw-fastner passing through both portions of the hydro-paddle. Alternately, reference to FIG. 6 shows a more convenient method of shifting the sliding lower/hydro-paddle 18' up/down in the opposed slide-channels 19/19'. Note here, how deflection-pressure is manually applied against the normally appearing lower-portion 18' in FIG. 6A, until in FIG. 6B the paddle's lower-portion 18' is sufficiently bowed 18'' via manual-pressure 26'' (ref.arrow), as to enable integral teat 27 to lift free of detent-hole 25, thereby facilitating manual shifting to alternate detent-holes 25' or 25'' for example; a ruggedly durable, albeit desirably simple means by which to eliminate time and nuisance of special tools and fasteners.

Supportive FIGS. 3, 4, 5, further reveal the relationship of the footgear's various features, such as the vertically aligned alternate detent adjustment-holes 26' and 26'' relative to location of the fixed detent teat 27.

Therefore, it is understood that the utility of the foregoing adaptations of this invention are not necessarily dependent upon any prevailing invention patent; and while the present invention has been well described hereinbefore by way of preferred embodiments, it is to be realized that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation. Accordingly, the embodiments of the invention in which an exclusive property or proprietary privilege is claimed, are defined as follows.

What is claimed:

1. An aquatic footgear comprising:

a platform-sole adapted to be supported beneath a wearer's foot having a top surface, a bottom surface, a front end portion, a back end portion, and a longitudinal axis, said platform-sole further comprising retentive means having straps adapted to extend over the upper portion of the foot and thereby securing said platform-sole to the foot;

a hydro-paddle member with two ends connected at one of said ends to the bottom surface of said platform-sole transverse to the longitudinal axis, said hydro-paddle member swingable between a first position of high drag wherein said hydro-paddle member is positioned substantially perpendicular to said bottom surface of said platform-sole and a second position of low drag wherein said hydro-paddle member is positioned at an acute angle with respect to the bottom surface of the platform sole and said other end of said hydro-paddle member is positioned below the back end of said platform-sole;

a first stopper device extending from the platform-sole adjacent the connected end of the hydro-paddle member for preventing the hydro-paddle member from swinging forward beyond the first position; and a second stopper device extending from the platform-sole proximal to the back end portion thereof for preventing the hydro-paddle member from swinging aftward beyond a predetermined maximum position.

2. The aquatic footgear of claim 1 wherein said platform-sole further comprises a first pair of laterally opposed longitudinal slots at the front end portion thereof for receiving a first flexible strap and a second pair of laterally opposed longitudinal slots at the back end portion thereof for receiving a second flexible strap.

3. The aquatic footgear of claim 2 further comprising a third strap connecting said first strap to said second strap and wherein the first and second straps further comprise fastening means.

4. The aquatic footgear of claim 1 wherein the hydro-paddle member comprises a first portion having a top end, a bottom end and two sides and a second adjustable extension portion slidably connected to said first portion for adjusting the resistance provided by said hydro-paddle member wherein said first portion is connected at the top end thereof to said platform-sole.

5. The aquatic footgear of claim 4 wherein said hydro-paddle member further comprises adjustment means for holding said second adjustable extension portion in one of a plurality of preselected positions on said first portion.

6. The aquatic footgear of claim 5 wherein said adjustment means comprises holes in said second adjustable extension portion and a detent in said first portion.

7. The aquatic footgear of claim 4 wherein said first portion further comprises a pair of opposed channels on the sides thereof for slidably supporting said second adjustable extension portion.

8. The aquatic footgear of claim 1 wherein said first and second stopper devices have bottom surfaces which cooperate with the hydro-paddle member to allow a wearer to walk on a hard surface without damaging said aquatic footgear.

9. The aquatic footgear of claim 8 wherein said bottom surfaces are configured to enable a wearer to walk upon a pool bottom with imposing scuff damage thereon.

* * * * *